US005957557A

United States Patent [19]

Langer et al.

[11] Patent Number: 5,957,557

[45] Date of Patent: Sep. 28, 1999

[54] SYSTEM CONSISTING OF KITCHEN APPLIANCE HOUSING UNITS AND/OR KITCHEN UNITS

[75] Inventors: Otto Langer, Neumarkt-St. Veit; Thomas Haberl, Freising-Attaching; Robert Heizinger, Neumarkt-St. Veit, all of Germany

[73] Assignee: bulthaup GmbH & Co. Küchensysteme, Aich, Germany

[21] Appl. No.: 08/905,596

[22] Filed: Aug. 4, 1997

[30] Foreign Application Priority Data

Aug. 5, 1996 [DE] Germany ..... 196 31 639

[51] Int. Cl.[6] ..... A47B 81/06

[52] U.S. Cl. ..... 312/223.6; 220/4.02; 312/236; 361/724; 174/65

[58] Field of Search ..... 312/198, 223.6, 312/287, 107, 223.1; 220/4.26, 4.27, 4.28, 23.6, 4.02; 174/50, 65, 52.1; 361/727, 724

[56] References Cited

U.S. PATENT DOCUMENTS

| | | | |
|---|---|---|---|
| 2,612,590 | 9/1952 | Lachowicz | 312/107 |
| 4,679,867 | 7/1987 | Heldenbrand et al. | 312/287 |
| 4,699,270 | 10/1987 | Bohm | 312/198 |
| 4,828,340 | 5/1989 | Jorgensen | 312/236 |
| 4,895,001 | 1/1990 | Jondahl | 312/236 |
| 4,935,593 | 6/1990 | Nishikawa | 312/236 |
| 5,156,556 | 10/1992 | Ma | 220/4.27 |
| 5,508,891 | 4/1996 | Rowe et al. | 361/727 |
| 5,747,734 | 5/1998 | Kozlowski et al. | 174/50 |

FOREIGN PATENT DOCUMENTS

| | | |
|---|---|---|
| 254448 | 5/1967 | Austria . |
| 2303548 | 8/1973 | Germany . |
| 2519894 | 11/1976 | Germany . |
| 3120723 | 3/1983 | Germany . |

*Primary Examiner*—Peter M. Cuomo
*Assistant Examiner*—Gerald A Anderson
*Attorney, Agent, or Firm*—Dilworth & Barrese

[57] ABSTRACT

The invention relates to a system consisting of kitchen appliance housing units and/or kitchen units which can be stacked on top of each other and combined with each other. According to the present invention the housing units and/or kitchen units are all provided with a service channel in a predetermined and fixed location, through which service pipes and cables, for example, electricity, gas, water, waste water, run. The housing units and/or kitchen units all have a stacking support structure and are linked together by coupling elements which also allow them to be separated.

29 Claims, 12 Drawing Sheets

SYSTEM CONSISTING OF KITCHEN APPLIANCE HOUSING UNITS AND/OR KITCHEN UNITS

The invention relates to a system consisting of kitchen appliance housing units and/or kitchen units which can be stacked on top of each other and combined with each other.

BACKGROUND OF THE INVENTION

In the kitchen area, appliances are installed either as upright units or, more widely, as built-in units. Appliances which are built in require extensive modifications to the wooden carcass and facings with front panels which match the other kitchen units. Furthermore, wood is sensitive to dampness and the effects of heat. As the appliances come in different heights which do not match the units of height used by the kitchen unit manufacturer, it is necessary to resort to extensive modifications involving the use of filler units. This makes installation very expensive.

The appliances, which often have been produced by different manufacturers, have different shapes, controls, dimensions and functions. Every appliance has its own power supply and different power consumption. Installation must be carried out by a specialist electrician. These electrical appliances are generally not stackable for static reasons. Moreover, the side and back panels do not have the same finish as the front panels so that it is undesirable to have them freely exposed to view. Since every built-in appliance must be harmonized with the kitchen units, planning and measuring up requires a lot of effort and the possibility of errors occurring which could be the cause of complaints is by no means small.

The provision of external panels for appliances and the modifications to the wooden carcass which are also necessary have the effect of doubling the cost of installation as well as resulting in a loss of space. This applies also to the doors, which often have to be constructed as double doors consisting of the appliance front in combination with a kitchen unit front panel. An additional loss of usable space results from the unfavorable arrangement of the individual elements within the control panel, as is the case, for example, in ovens.

When the control elements are inside, appliances are difficult to handle and it is almost impossible to monitor the functioning of the equipment. An example of this is a fully built-in dishwasher.

In the event that a family moves house and wishes to re-locate their appliances, new housing units are necessary to adapt to the new kitchen layout, resulting in additional costs. Upright units and built-in appliances cannot satisfy the increasing requirement for mobility, both with regard to moving home and also within the same home. Current systems and especially appliance systems are not flexible enough.

SUMMARY OF THE INVENTION

It is therefore an object of the present invention to make available a system consisting of kitchen appliance housing units and/or kitchen units which can be stacked on top of each other and combined with each other, which is as far as possible free of the above-mentioned disadvantages. In particular, it should be possible to integrate the appliance housing units flexibly and without elaborate installation requirements.

This object is achieved in the present invention by the generic system whose characteristic features include the appliance housing units and/or kitchen units being linked up together by means of coupling elements which enable them to be detached. According to this, the housing units and/or kitchen units are all provided with a service channel in a predetermined and fixed location, through which service pipes and cables, for example, electricity, gas, water, waste water, run. Furthermore, the housing units and/or kitchen units can be joined together but still remain detachable because the housing units and/or the kitchen units have a common support structure which is fitted with appropriate coupling elements. In the service channel, service pipes and cables, coupling points (socket systems), waste water pumps, continuous flow water heaters and control units can be arranged, effectively forming a general energy supply system. Energy is distributed between individual modules through socket systems. The power consumption of each module is fixed. The modular design makes it possible to control and regulate the kitchen appliances centrally, for example using a bus system in a domestic adaptation of process control technology. In this way, condition and failure monitoring can also be carried out centrally and fault diagnosis by the after-sales service can be undertaken remotely. A test plug, to which corresponding diagnostic devices can be attached, can also be installed. Through the service channel and the linking up of supply pipes and cables between the individual housing and/or kitchen units, the energy supply can be regulated centrally. Thus, for example, the waste heat from the refrigerator can be stored or used for heating purposes or to heat up water via appropriate heat exchangers in the service channel. Again, any condensation generated can be used for humidification in an air conditioning module. In short, a system produced according to the present invention is not only a system made up of standardized appliance housing and/or kitchen units whose dimensions and coupling system enable them be joined together, but it also embodies an optimized energy supply concept. It is no longer necessary for the individual kitchen appliance elements to be fitted separately.

Preferred embodiments of the invention are described in the disclosure herein.

In a preferred embodiment of the present invention, the service channel can be arranged in the area of the back panel of the appliance housing and/or kitchen units. Here the service channel can preferably be accommodated in a recess which is accessible from the side and can be closed with a cover.

The service pipes and cables in the service channel are preferably arranged in a predetermined order and can be connected up with each other via a connecting socket system between the units.

The housing and/or kitchen units make use of a support structure which permits stacking. This structure can be based on a system of load-bearing tubes or it can be formed from self-supporting side panels fitted with coupling points.

In a preferred embodiment of the invention, housing units which are used in the system according to the present invention are constructed in such a manner that they have, physically separate from each other, a usable area, an area for the energy supply units, control elements etc. and a service channel. The usable area is located in the area nearest to the front panel and the service channel in the area of the back panel, while the area for the energy supply units and control elements can be positioned between the usable area and the service channel. The usable area is thus closest to the user while all the energy supply units are accommodated towards the rear of the appliances. In this way, losses of space such as occur for example in conventional ovens due to the comparatively large control box in the front area, are largely avoided.

Ovens, air conditioning fans, warming compartments, dishwashers, extractor fans, air conditioning units, washing machines, dryers, refrigerators or freezers, for example, can be accommodated in the housing units according to the present invention.

BRIEF DESCRIPTION OF THE DRAWINGS

Further details and advantages of the invention will be described in more detail with the aid of the examples of the invention which are illustrated in the accompanying drawings.

DESCRIPTION OF THE PREFERRED EMBODIMENTS

Figure 1:
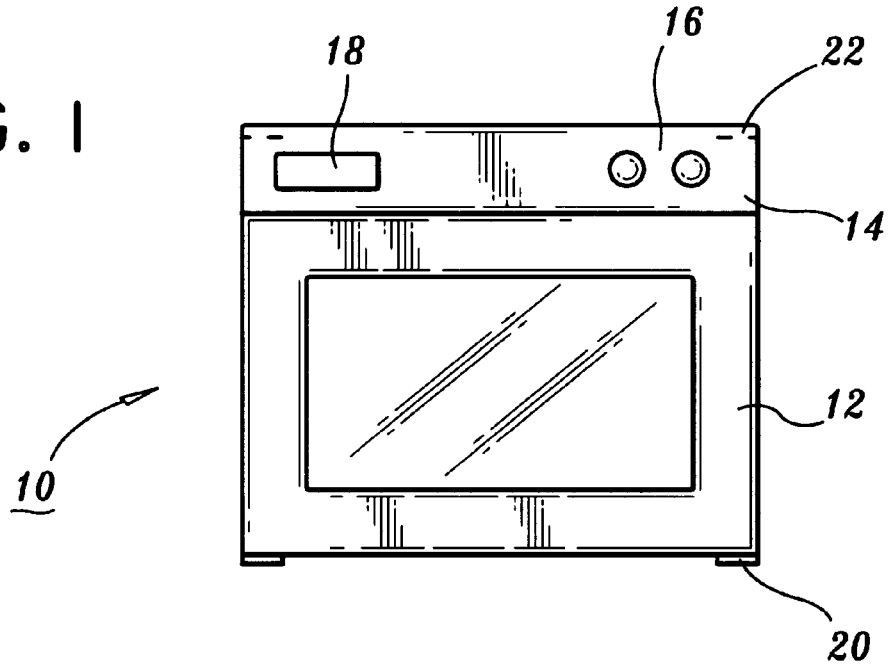
FIG. 1 provides a front view of a housing unit according to one embodiment of the present invention, FIG. 2 provides a side view of the housing unit illustrated in FIG. 1.
Figure 2:
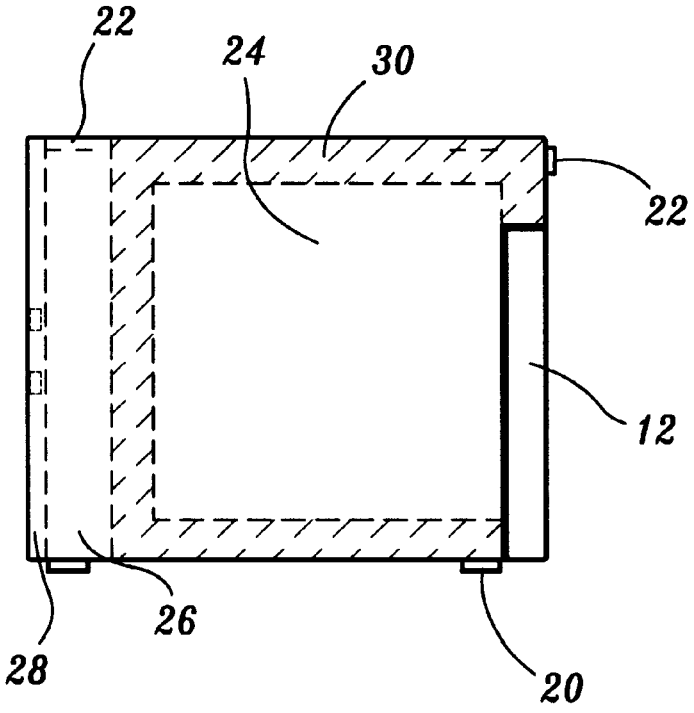

In FIG. 1 an oven 10 is shown as an example of a housing unit according to the present invention. It has an appliance front panel 12, a control facia 14 with controls 16 and a display 18. The coupling feet shown at 20 slot into corresponding recesses 22 in a second appliance onto which this one is to be stacked. The side view provided in FIG. 2 shows how the inner space of the oven unit is divided into a usable area 24 nearest to the user, a space for the appliance energy supply units and controls 26 and a service channel 28 arranged in the area of the back panel, is shown. The energy supply units, located behind the usable area 24 in the space at 26, are controlled from the switch 22. Around the usable area insulation 30 is provided. The appliance front panel 12 consists, for example, of a flap or revolving door with a vertical handle (not shown).

Figure 3:
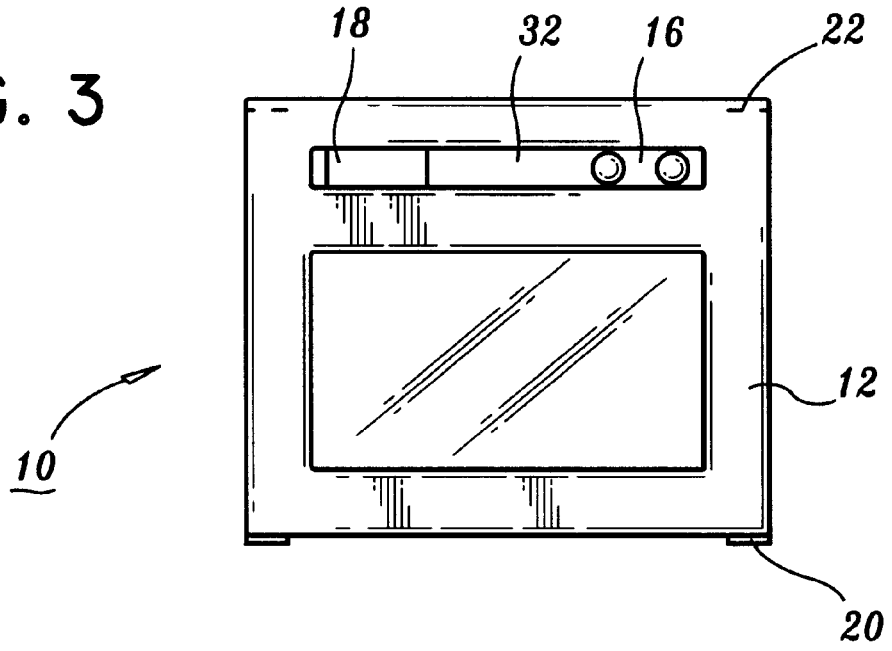
FIG. 3 shows a housing unit according to a further embodiment of the present invention, FIG. 4 provides a side view of the housing unit illustrated in FIG. 3, FIGS. 5 & 6 are perspective drawings of housing units according to a preferred embodiment of the present invention, FIG. 7 provides a sectional view of a part of the housing unit shown in FIG. 5.
Figure 4:
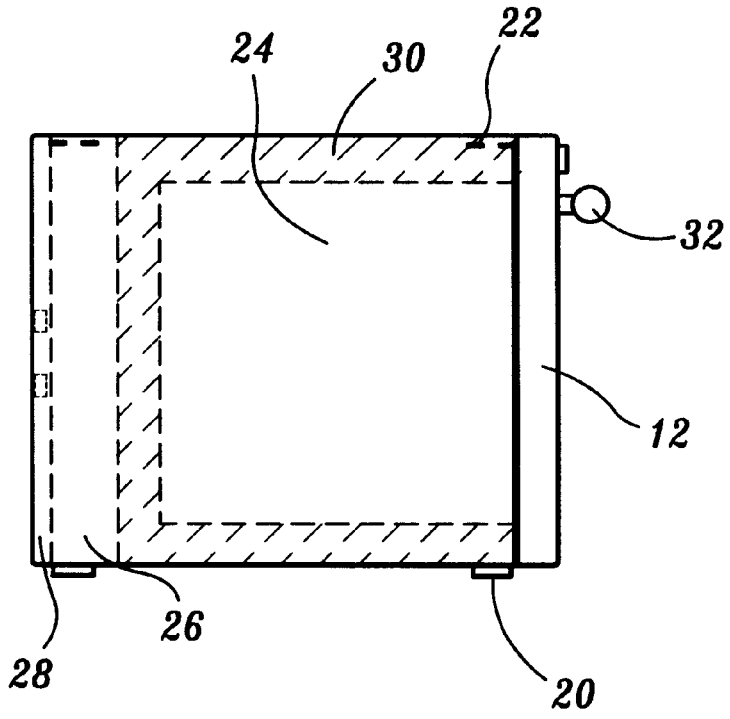

In FIGS. 3 and 4 a variant of an oven is shown which differs from that shown in FIGS. 1 and 2 in that the switches and display 16/18 are arranged in a horizontal bar handle 32.

Instead of an oven, such as is shown in FIGS. 1–2 and 3–4, a dishwasher, air conditioning unit, refrigerator or any other kitchen appliance can here be accommodated in accordance with the present invention as a built-in unit. In each case, the appliance is fitted with coupling elements 20/22 at equivalent locations and has a usable area, an area for the energy supply units and controls and a service channel as well as a support structure capable of being stacked. The construction of the stackable support structure is illustrated FIGS. 5 and 6, in which different support structure designs are shown.

Figure 5:
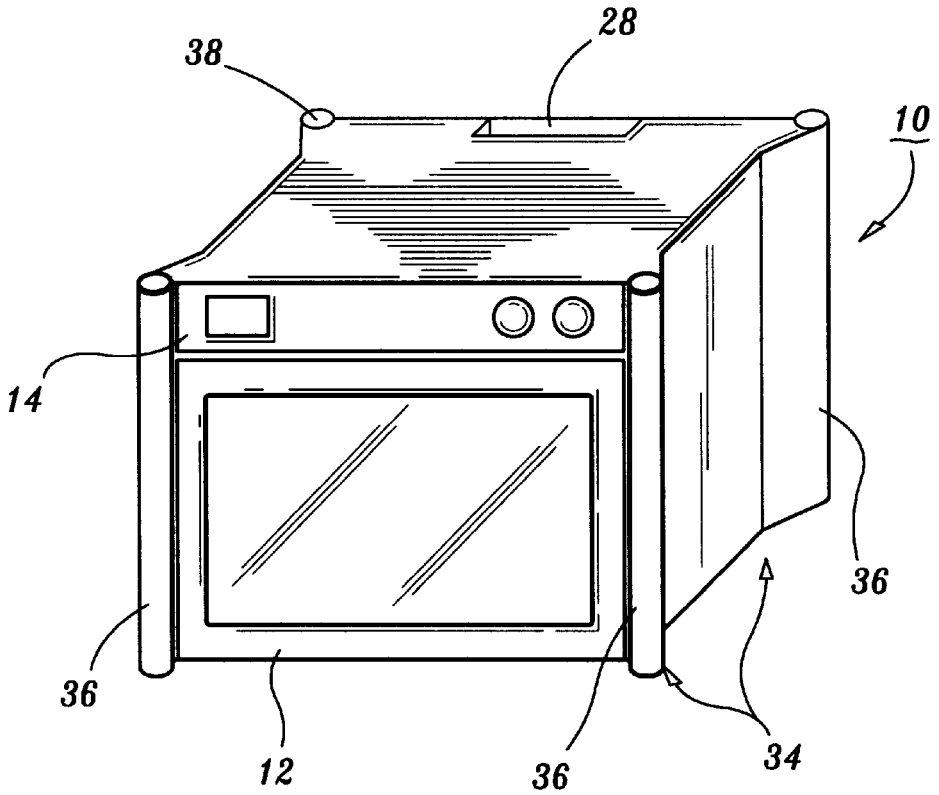
Figure 7:
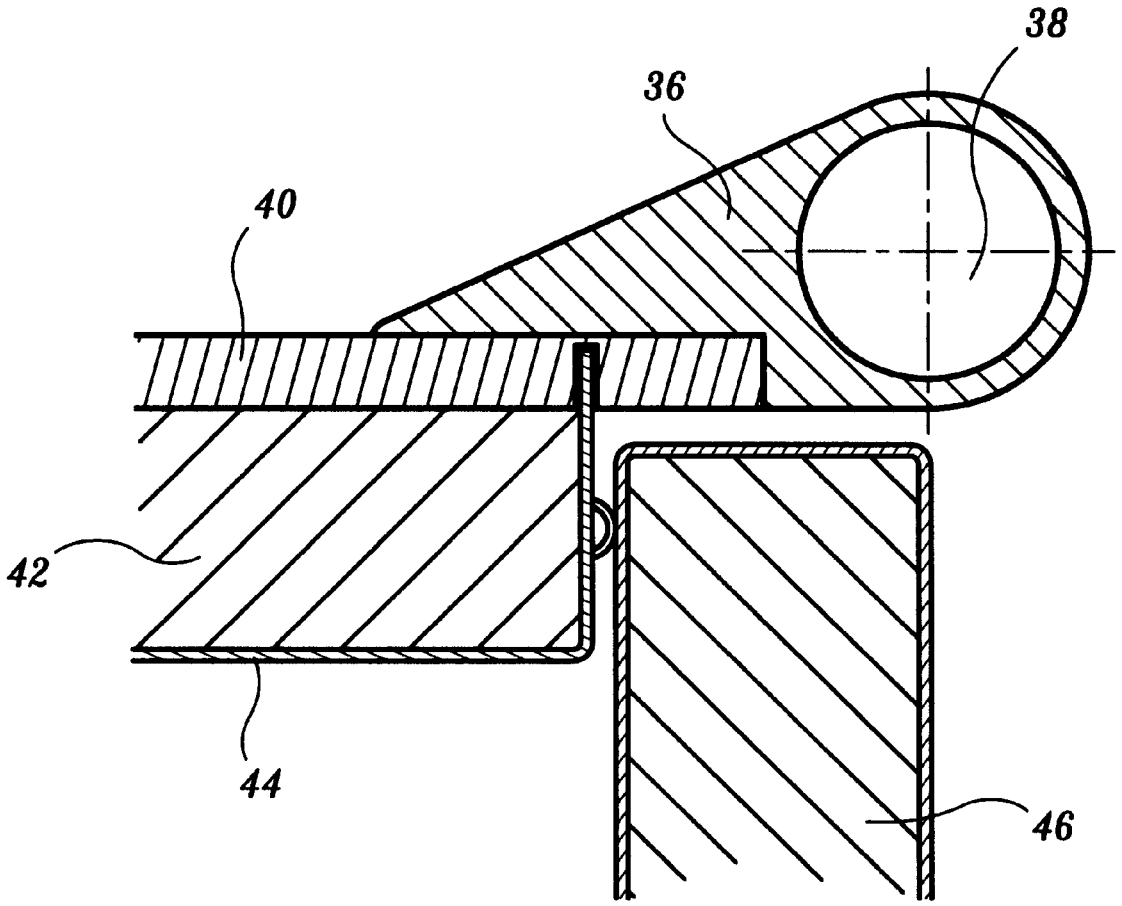

In FIG. 5 the oven 10 has a support structure based on a system of load-bearing tubes 34 which consists of individual vertically running load-bearing tubes which are arranged in the corners. The design of a corner area is shown in FIG. 7. The diagram shows connection element 36 from the previous example, which is preferably constructed of metal and projects outwards to the side so as to accommodate a tube, while on its inner side it has a recess at which a facing of metal, wood or synthetic material 40 is fixed. Attached to this facing is an insulation unit 42, which is lined along its inside edges adjacent to usable area 24 with a panel 44 made of steel, special steel or synthetic material. The front panel of the housing unit, which consists of an insulation core enclosed within a metal or synthetic material case, is shown at 46. The tubular system 36 can be joined to another tube 36 belonging to an appliance placed on top, by inserting a tube whose external diameter is the same size as the diameter of coupling point 38 between the two units. The inserted tube (not shown) can be locked into position, for example using attachment screws.

Figure 6:
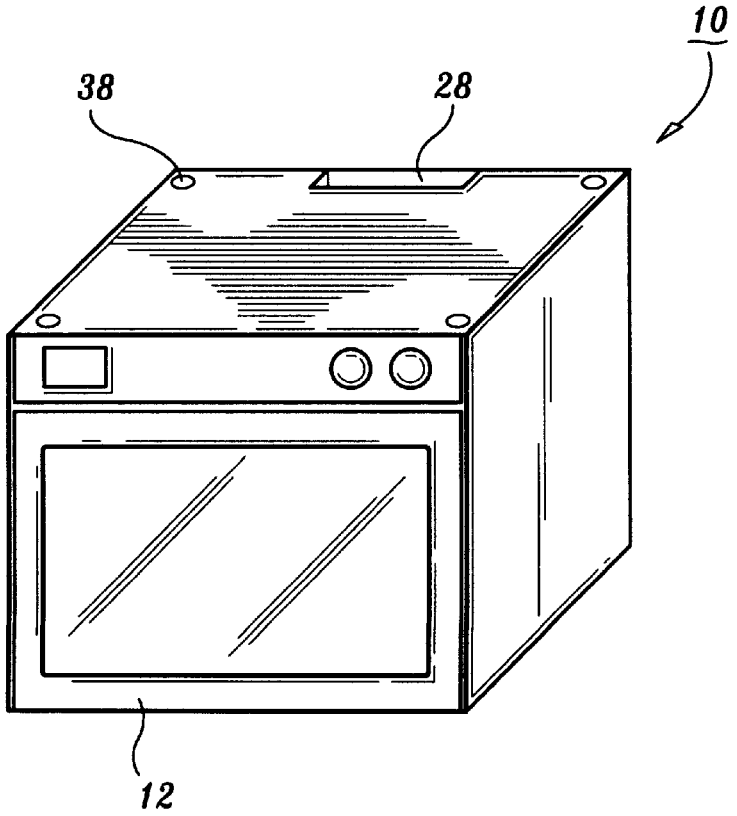
Figure 8:
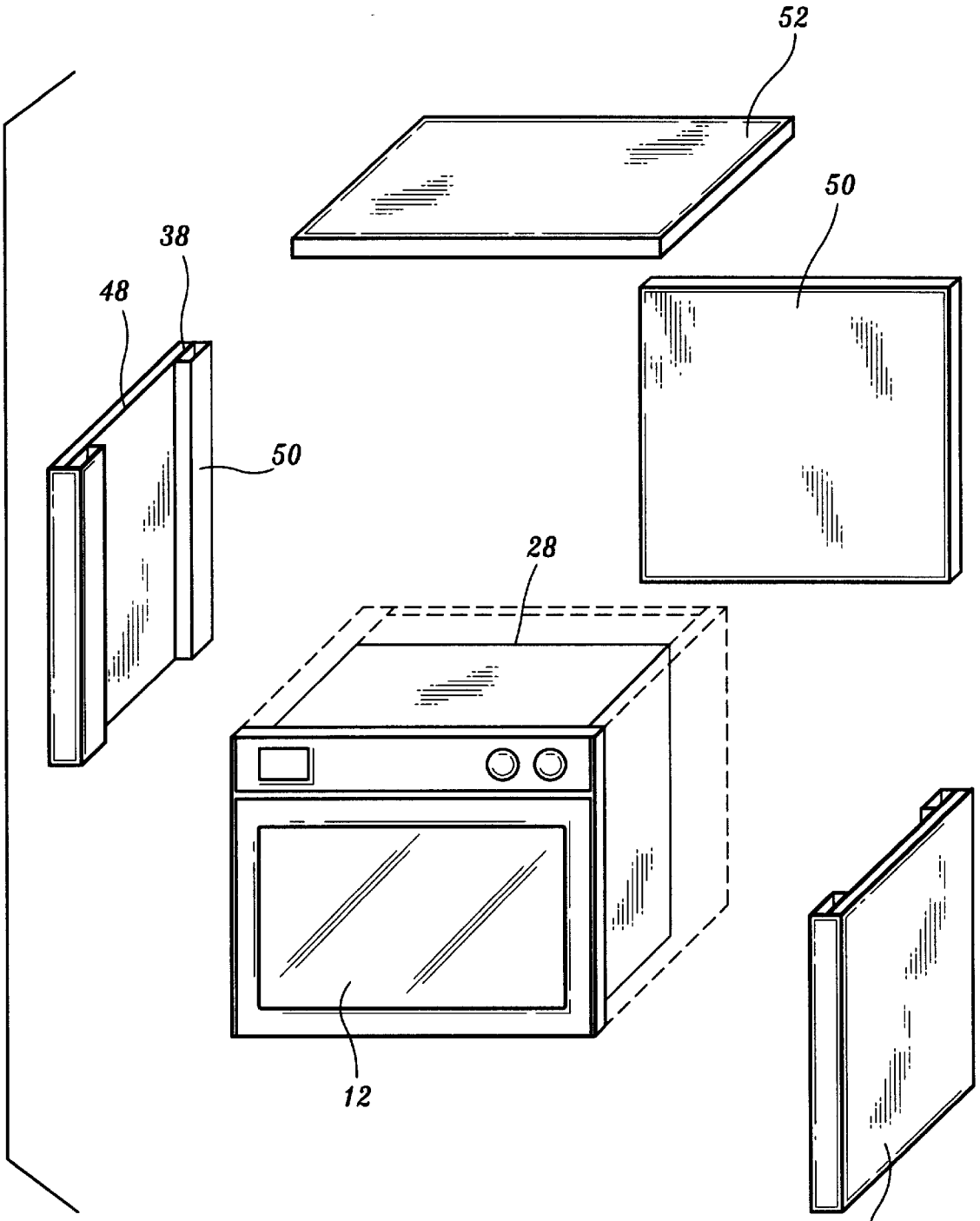
FIG. 8 is a perspective view of the housing unit shown in FIG. 6, shown with its pieces dismantled.

In the example of the invention illustrated in FIG. 6 the oven is designed as a stackable box whose construction can be seen from FIG. 8. Here, self-supporting side panels 48 which have hollow strengthening pieces 51 at their forward and rear edges are provided to the side. These hollow strengthening pieces 51 each define a coupling point 38; these coupling points 38 are the equivalent of the coupling points explained by means of FIGS. 5 and 7. In addition a back panel 50 and a cover 52 are provided.

Figure 9:
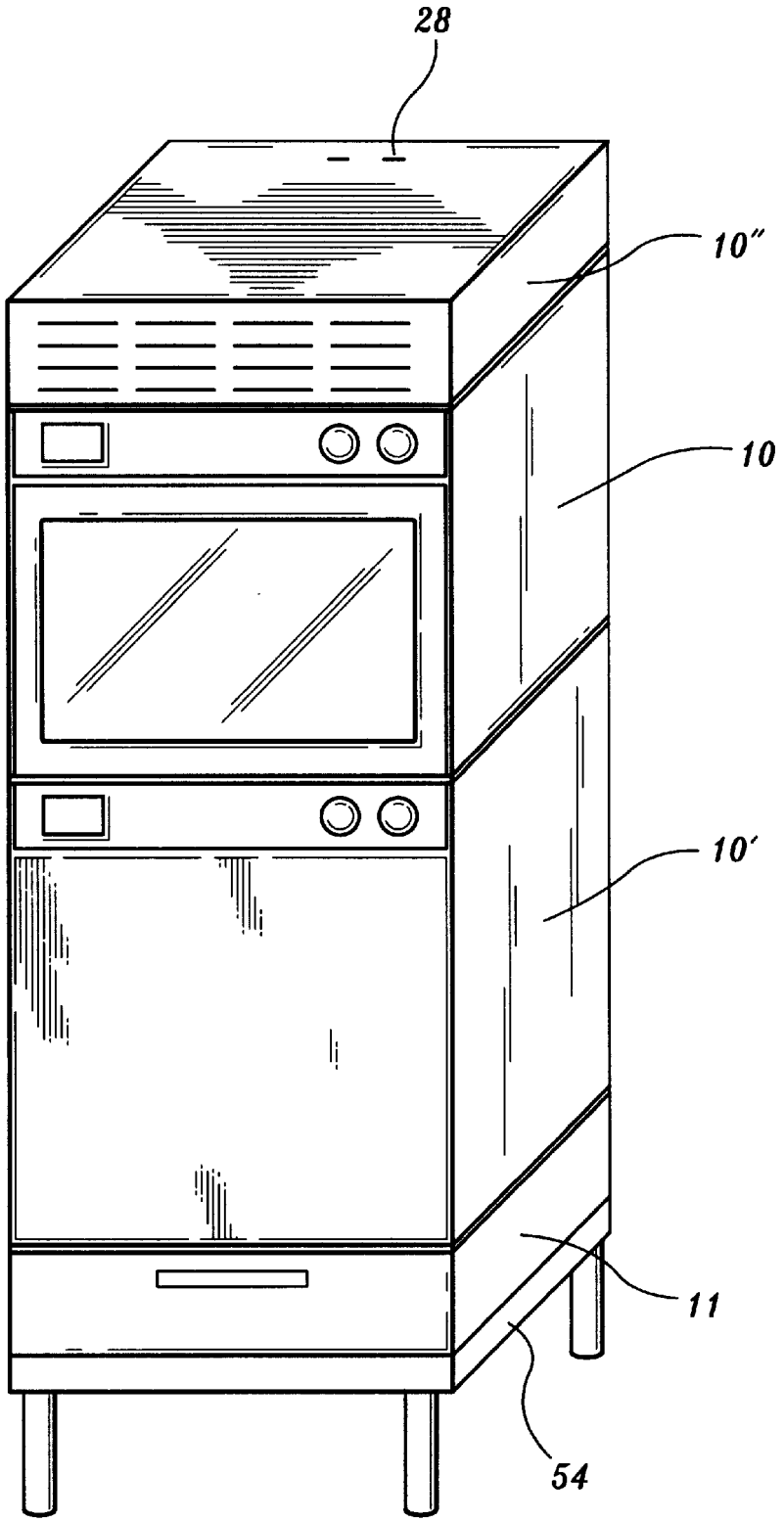
FIGS. 9 & 10 show different stacking variants of the system according to the present invention in perspective view, and FIGS. 11 to 18 provide details of the stacking variants illustrated in FIGS. 9 and 10, some in plan view, some in sectional view and some in perspective view.
Figure 12:
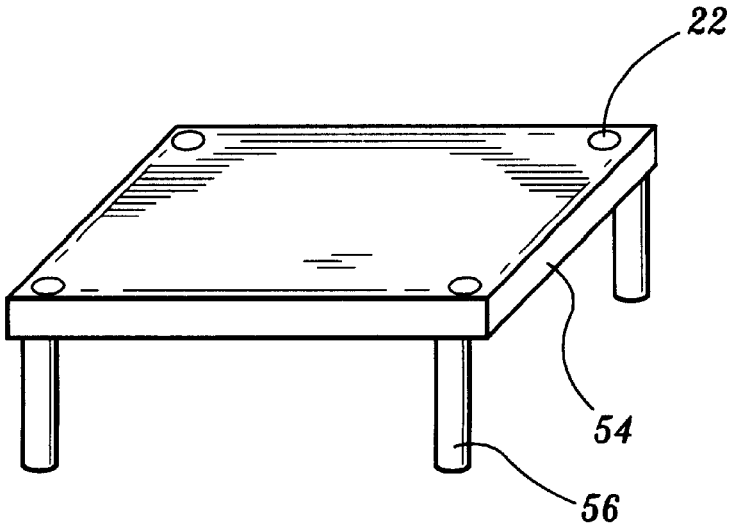

In FIG. 9 a stacking module is shown by way of example, in which different housing units and kitchen units are stacked on top of each other into one complete module. The individual housing units and kitchen units stand on a pallet 54 which is repeated in FIG. 12, this time in a perspective representation. As can be seen from FIG. 12, here also matching coupling points 22 are provided. Pallet 54 stands on four legs 56. In the stacking module shown in FIG. 9 a pull-out drawer module 11 is arranged on pallet 54 as kitchen unit. Stacked on this are, from bottom to top, a freezer unit 10', an oven 10 and an extractor hood 10". The space available for service pipes and cables, which extends down the entire height of the stacking module, is shown at 28.

Figure 10:
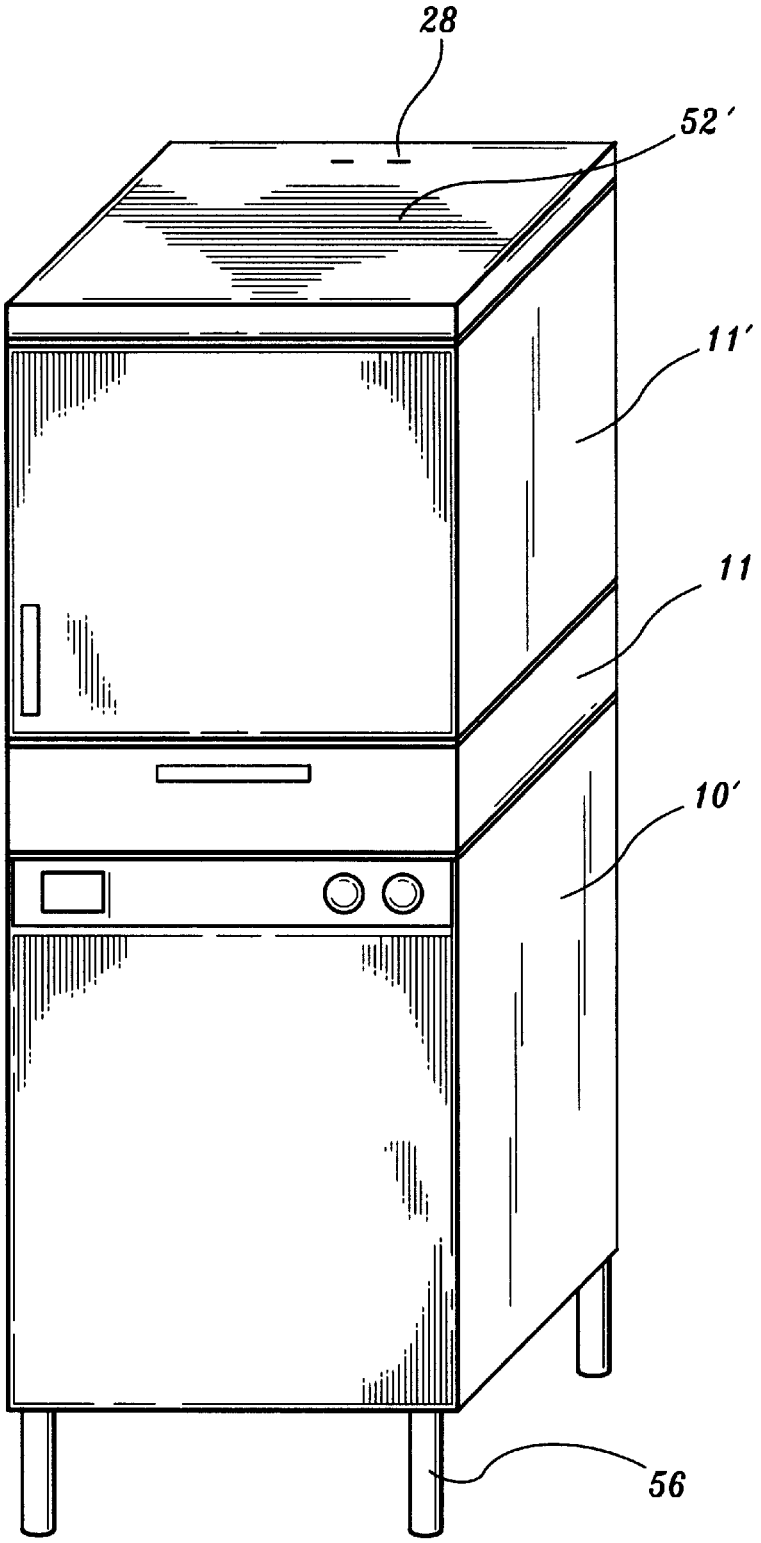

In FIG. 10 an alternative arrangement of a stacking module is shown. Here, the bottom appliance module is once again a freezer unit 10'. Legs 56 are attached directly to the base of the unit. A pull-out unit 11 is arranged on top of the refrigerator unit 10'. Above the pull-out unit 11 is a storage module with door 11', which is covered over by plate 52'. The service channel, which extends down the full height of the stacking module in accordance with FIG. 10, is also shown here at 28.

Figure 11:
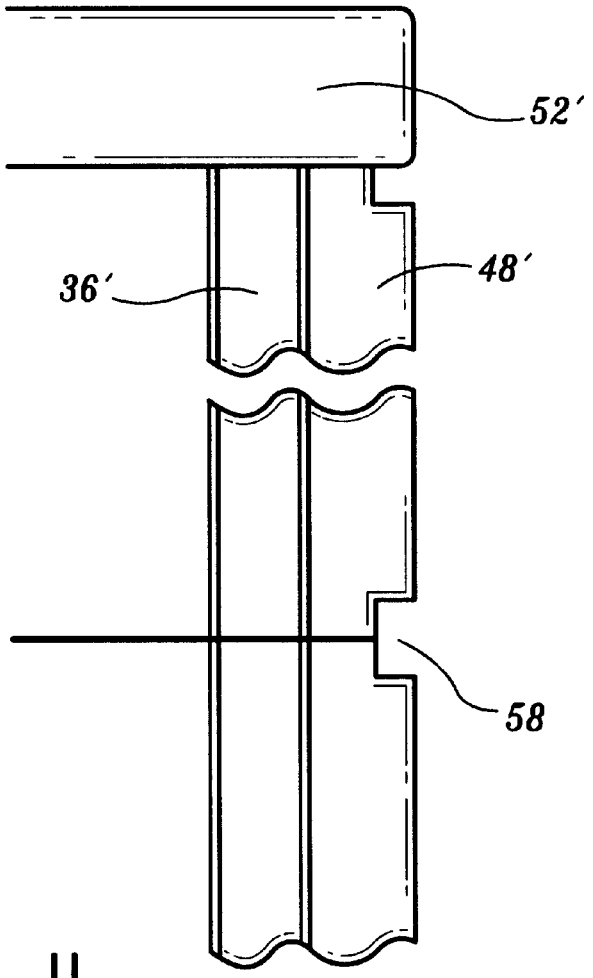

In FIG. 11 the support structure design of the embodiment presented in FIG. 10 is shown in detail. The support structure consists essentially of hollow constructions 36', on which the cover 52' rests. Towards the outside a panel 48' is attached. This, for example, can have visible joints 58 at the transition points between the individual units.

Figure 13:
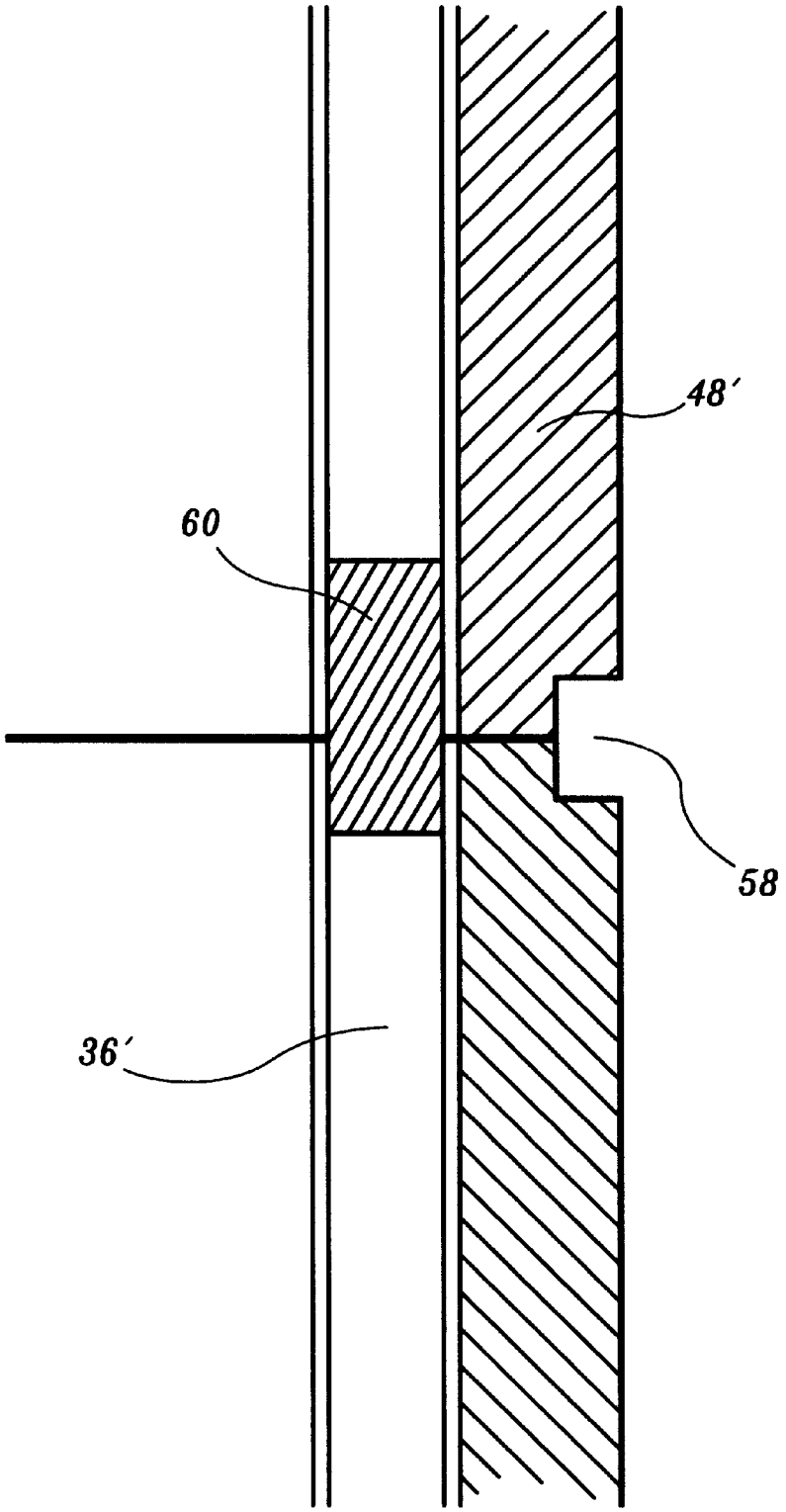

FIG. 13 shows a similar version of the support structure design illustrated in FIG. 11. The diagram shows how the tubes 36' are linked up together via a connecting element 60, adapted to the internal diameter of the tube. This connecting element 60 can be secured, for example, by means of attachment screws.

Figure 14:
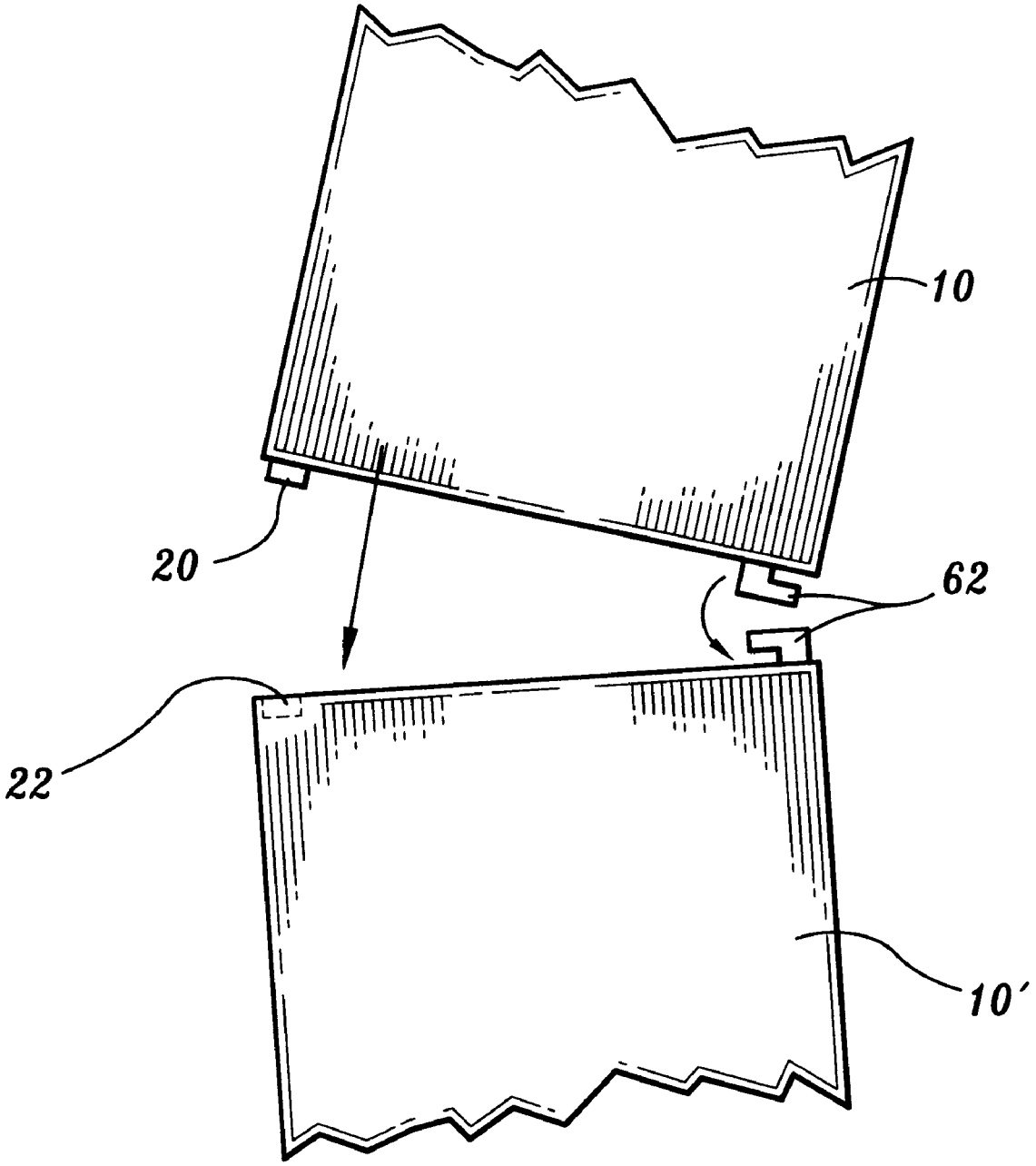

FIG. 14 shows two housing units 10 and 10' which have an alternative detachable coupling. Thus, an L-shaped bar 62 is so arranged on the units 10 and 10' that it can mate with the respective other bar in the manner shown here in FIG. 14. On the opposite side, a corresponding coupling stud 20 slots into a recess 22. Through the force of gravity the units 10 and 10' stacked on top of each other are adequately secured. A covering locking plate can be screwed on here.

Figure 15:
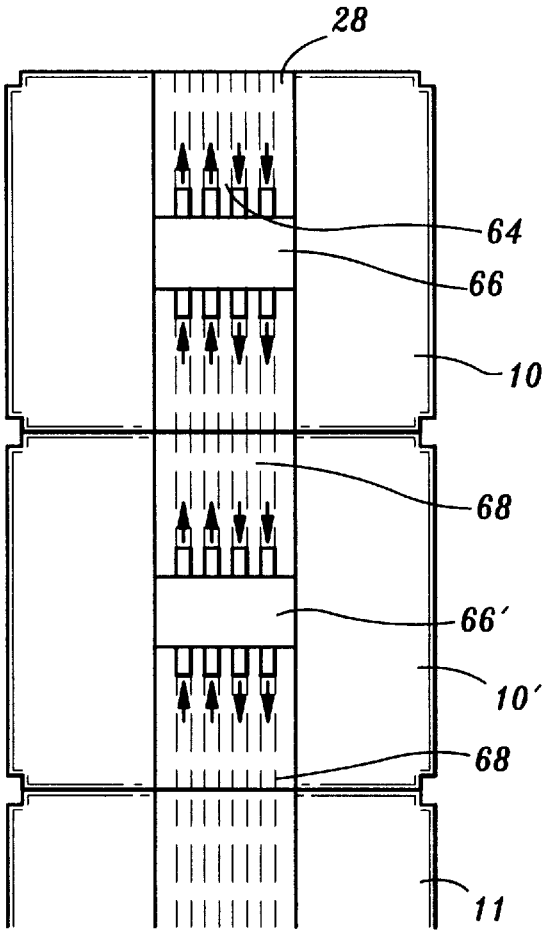

In FIG. 15, the back panel of a module, such as the one presented in FIG. 9, is shown with service channel 28 in its uncovered state. Inside the service channel are service pipes and cables 64 for electricity, water, waste water and gas. In the area of connectors 66, the pipes etc. serving kitchen unit 10/10' branch off. In the area of kitchen unit 11 the pipes etc. run through the relevant portion of the service channel without any junction points having to be provided here. At the transition between modules 10 and 10' and 10' and 11, connecting conduits in the form of a socket system 68 have been provided.

Figure 17:
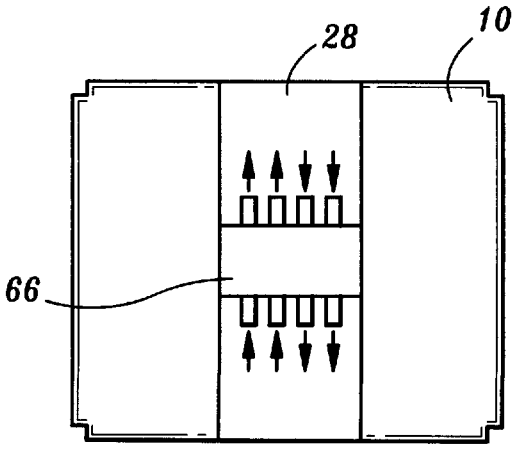

FIG. 17 shows the back panel of an individual housing unit 10 again with uncovered service channel 28, also connector 66 via which the energy supply units in the space provided for them are supplied.

Figure 16:
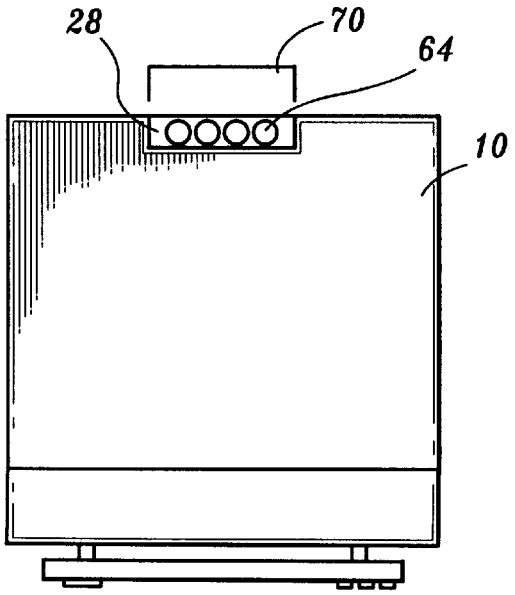

In the plan view provided in FIG. 16 the service channel 28 is shown with the pipes and cables 64 which run inside it and the cover 70 removed.

Figure 18:
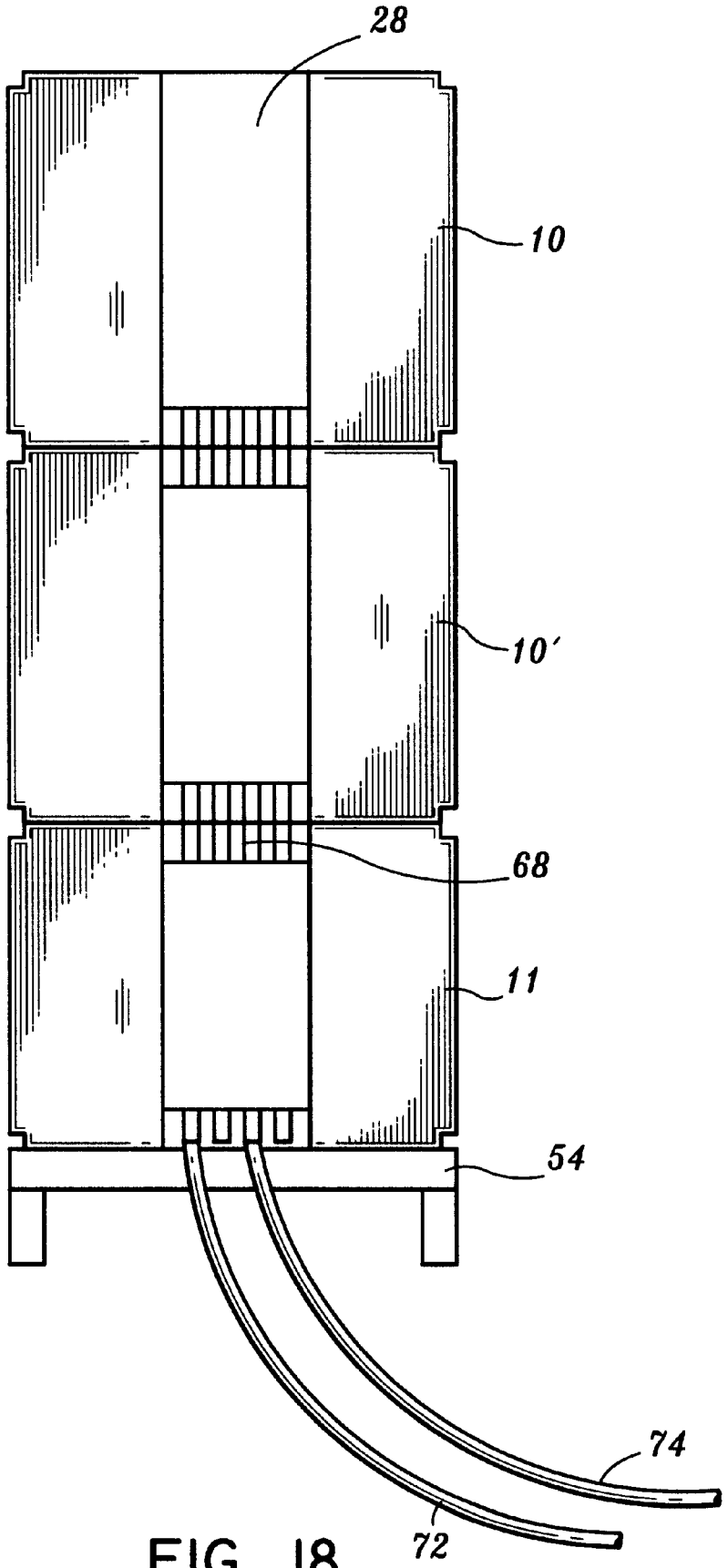

FIG. 18 likewise shows the back panel of a stacking module comprising several units stacked on top of each other as per FIG. 9 and therefore is similar to the module shown in FIG. 15. Here the pin-and-socket connectors 68 are again schematically depicted. Items 72 and 74 refer to electricity and water connections which are connected to the service pipes and cables 64 by means of a socket system.

We claim:

1. System comprising at least one of kitchen appliance housing units and kitchen units which are arranged to be stacked on top of each other and combined with each other, wherein the units are all provided with a service channel in a fixed location, through which service pipes and cables run, the units are linked up together by means of coupling elements which enable the units to be detached, and each housing unit for said system comprises (1) a usable area, (2) an area for at least one of energy supply units and control elements, and (3) said service channel, said areas (1)–(3) being physically separated from one another in each said housing unit.

2. System according to claim 1, wherein the service channel is located in an area of a back panel of the units.

3. System according to claim 2, wherein the service channel is designed as a recess which is accessible from the back panel of the housing units and/or kitchen units and can be closed with a cover.

4. System according to claim 3, wherein the service pipes and cables in the service channel are arranged in a predetermined order and can be connected up via a connecting socket system between the units.

5. System according to claim 3, wherein the housing units and/or kitchen and/or kitchen units have a support structure which permits stacking.

6. Housing unit for a system according to claim 3, wherein it has, physically separate from each other, a usable area, an area for the energy supply units, control elements, etc. and a service channel.

7. System according to one of claim 1, wherein the service pipes and cables and cables in the service channel are arranged in a predetermined order and can be connected up via a connecting socket system between the units.

8. System according to claim 7, wherein the housing units and/or kitchen units have a support structure which permits stacking.

9. System according to claim 2, wherein the service pipes and cables and cables in the service channel are arranged in a predetermined order and can be connected up via a connecting socket system between the units.

10. System according to claim 2, wherein the units have a support structure which permits stacking.

11. System according to claim 1, wherein the units have a support structure which permits stacking.

12. System according to claim 11, wherein the stacking support structure is based on a system of load-bearing tubes.

13. System according to claim 11, wherein the stacking support structure is composed of self-supporting side panels with coupling points.

14. Housing units for a system according to claim 7, wherein it has, physically separate from each other, a usable area, an area for the energy supply units, control elements, etc. and a service channel.

15. A housing unit according to claim 1, wherein said unit is arranged to accommodate an oven, an air conditioning fan, a warming compartment, a dishwasher, an extractor fan, an air conditioning unit, a washing machine, a drier, a refrigerator or a freezer.

16. System according to claim 1, additionally comprising insulation situated about (1) said usable area.

17. System according to claim 1, comprising controls mounted upon a front panel of each said unit and coupled to said energy supply units/control elements in (2) said area therefor.

18. System according to claim 1, wherein said coupling elements include coupling feet on the bottoms of respective units and coupling recesses on the tops of respective units, such that said respective units can be stacked one on top of the other.

19. System according to claim 1, comprising at least one refrigerator.

20. System according to claim 1, additionally comprising said control elements/energy supply units situated in (2) said area therefor.

21. System according to claim 1, comprising at least one fluid conduit situated in said service channel.

22. System according to claim 21, wherein said fluid conduit is coupled to at least one of a waste water pump and a continuous flow water heater.

23. System according to claim 1, wherein said units are structured and arranged to be joined and fixed together but still remain detachable by a provision of a common support structure which is fitted with coupling elements.

24. System according to claim 1, additionally comprising socket systems arranged at coupling points between said units for distributing energy between individual modules housed in said respective units.

25. A housing unit for a system comprising at least one of kitchen appliance housing units and kitchen units which are arranged to stacked on top of each other and combined with each other, wherein the units are all provided with a service channel in a fixed location, through which service pipes and cables run, the units are linked up together by means of coupling elements which enable the units to be detached, each said housing unit comprises (1) a usable area, (2) an area for at least one of energy supply units and control elements, and (3) said service channel, said areas (1)–(3) all being physically separated from one another in each said housing unit, and three separate areas are arranged one behind the other between front and back panels of the units, such that the (1) usable area occupies an area nearest to the front panel, (3) the service channel occupies an area nearest the back panel, and (2) the area for the energy supply units/control elements occupies the intermediate area.

26. Housing unit according to claim 25, wherein said unit is arranged to accommodate an oven, an air conditioning fan, a warming compartment, a dishwasher, an extractor fan, an air conditioning unit, a washing machine, a drier, a refrigerator or a freezer.

27. Housing unit according to claim 25, additionally comprising said control elements/energy supply units situated in (2) said intermediate area.

28. Housing unit according to claim 25, additionally comprising controls mounted upon a front panel of each said unit and coupled to said energy supply units/control elements situated in (2) said intermediate area.

29. Housing unit according to claim 25, additionally comprising insulation situated about (1) said usable area in each said unit.

* * * * *